United States Patent [19]

Timleck

[11] Patent Number: 4,745,875

[45] Date of Patent: May 24, 1988

[54] GOLFING SCORE RECORDER

[76] Inventor: Robert C. Timleck, 9 Faith Avenue, Downsview, Ontario, Canada, M3H 1W2

[21] Appl. No.: 10,742

[22] Filed: Feb. 4, 1987

[51] Int. Cl.[4] ..... A63B 71/06

[52] U.S. Cl. ..... 116/222; 116/326; 273/162 A; 273/DIG. 26; 283/49

[58] Field of Search ..... 116/222, 223, 224, 225, 116/325, 326; 40/10 R, 10 D, 611, 618; 273/32 R, 32 A, 162 A, DIG. 26; 283/49, 48 R; 235/90

[56] References Cited

U.S. PATENT DOCUMENTS

| | | | |
|---|---|---|---|
| 990,640 | 4/1911 | Dodge | 116/222 |
| 1,224,452 | 5/1917 | Eaton et al. | 116/222 |
| 3,024,043 | 3/1962 | Lyman et al. | 116/222 |
| 3,226,019 | 12/1965 | Byrnes, Jr. | 116/326 |
| 3,716,016 | 2/1973 | Aylesworth et al. | 116/222 |
| 4,068,972 | 1/1978 | Stuart | 116/222 |
| 4,165,878 | 8/1979 | Frain | 283/49 |

FOREIGN PATENT DOCUMENTS

| | | | |
|---|---|---|---|
| 970416 | 9/1964 | United Kingdom | 40/100 |

*Primary Examiner*—William A. Cuchlinski, Jr.
*Assistant Examiner*—Patrick R. Scanlon
*Attorney, Agent, or Firm*—David W. Wong

[57] ABSTRACT

A golfing scores recorder consists of a generally rectangular case having a plurality of openings formed in a predetermined pattern provided in its front panel and a plurality of depressions of the same pattern formed in the inner surface of its rear panel. A perforable score card is insertable into the case. The score card has a score recording pattern printed thereon which has a plurality of score recording areas in register with the pattern of openings in the front panel of the case. The dimension of the openings in the front panel is sized to permit a golf tee to be inserted therethrough to pierce a mark in the score card to provide a permanent recording of the number of strokes played in each hole of the golf game.

5 Claims, 2 Drawing Sheets

12
13
10
11

IV 11
16
12
16
11
17
17
18
14
15
17
18
12
V
V
13
11
IV
17

14
13
15
12
18

GOLFING SCORE RECORDER

BACKGROUND OF THE INVENTION

This invention relates to a recording device for the golf game, and particularly relates to a device for providing a permanent unalterable recording of the number of strokes played in each hole in the golf game.

In the game of golf, scores are commonly recorded on a score card with pen or pencil. The score card only provides a recording of the total number of strokes played in sinking the ball in each hole. Often due to other associated activities and events happening in the golf course, the player would forget the actual total number of strokes played, thus resulting in an erroneous score record. Also, in making the recording, the player must carry a pen or pencil which often easily becomes lost in the course of the game and/or often becomes inoperative such as due to broken lead or exhausted ink. Furthermore, the score card is usually carried in the player's pocket and would often become mutilated or lost, resulting in the loss of proper scores recording.

Numerical counters sometimes are used for recording golfing scores. However, such counters do not provide a score card that may be presented for permanent records purposes. Such a score card record is particularly required in a golf tournament.

PURPOSE OF THE INVENTION

It is a principal object of the present invention to provide a golfing scores recording device which produces a permanent unalterable score card record.

It is an object of the present invention to provide a golfing scores recording device which is operative with the use of a common golf tee.

It is yet another object of the present invention to provide a convenient carrying case to protect the score card such that it would not become lost, mutilated or damaged in the course of the game.

BRIEF DESCRIPTION OF THE DRAWINGS

Other objects of this invention will appear in the following description and appended claims, reference being made to the accompanying drawings forming a part of the specification wherein like reference characters designate corresponding parts in the several views.

DESCRIPTION OF SPECIFIC EMBODIMENTS

Figures 1, 2, 3, 4, 5:
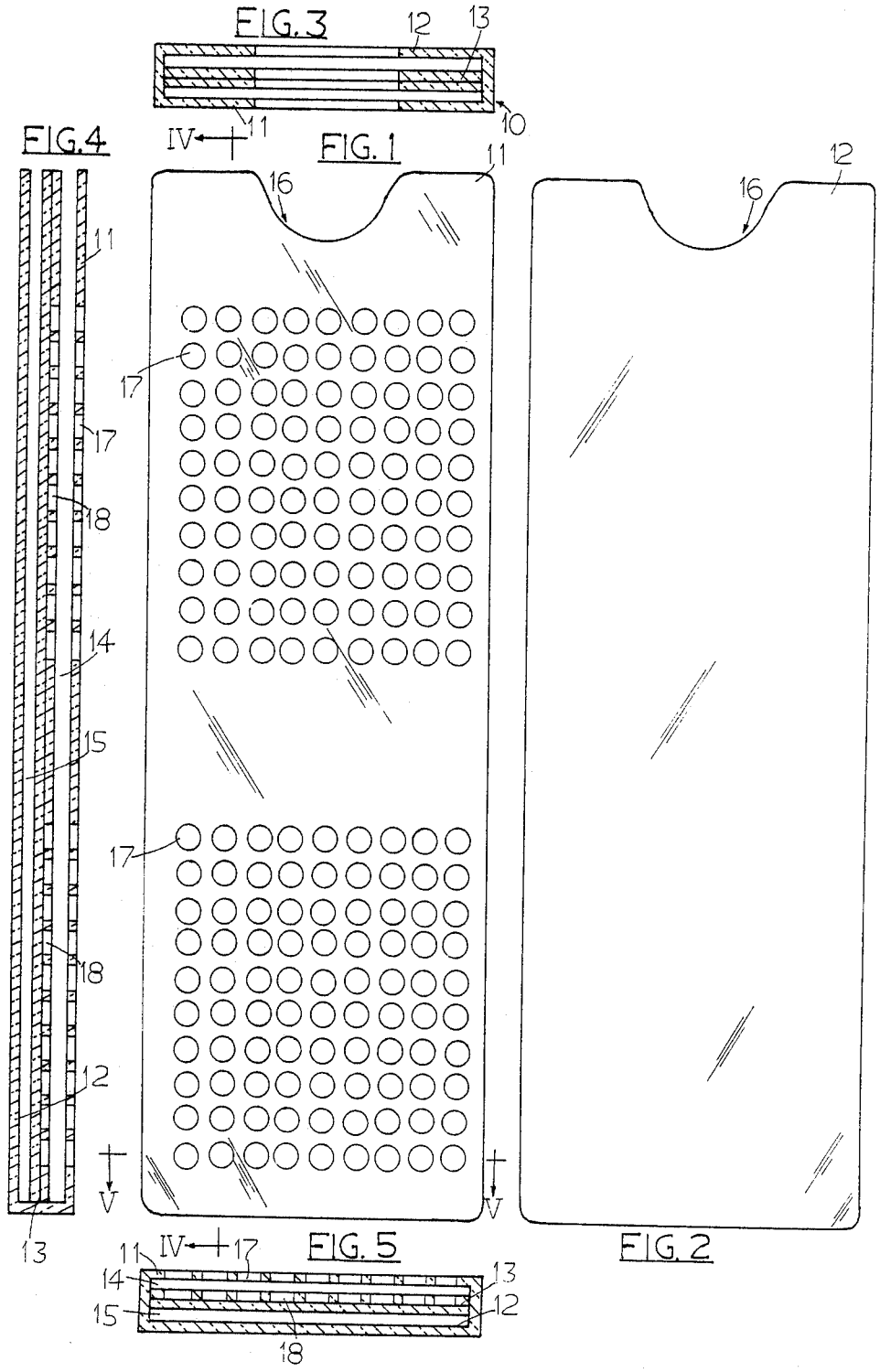
FIG. 1 is a front elevation of a recording device illustrating the present invention.
FIG. 2 is a rear elevation thereof.
FIG. 3 is a top elevation thereof.
FIG. 4 is a left sectional view thereof along section line IV—IV in FIG. 1.
FIG. 5 is a bottom sectional view thereof along section line V—V in FIG. 1.

Referring now to the drawings, all parts shown, unless otherwise indicated, are made of transparent plastic material. The recorder comprises an opened top rectangular case 10 having a front panel 11 and a rear panel 12. The interior of the case 10 is separated by a partition panel 13 into a front compartment 14 and a rear compartment 15. A semi-circular cut out 16 is provided at the top edge of the panels 11, 12 and 13.

A pattern of openings comprising two groups of nine rows of openings 17 are formed in the front panel 11 as best shown in FIG. 1. Typically, ten openings are provided in each row. Each opening 17 may have a cross section dimension, for example, approximately 3/16 inch diameter so as to permit a common golf tee to be inserted therethrough. Also, two groups of nine rows of depressions 18 are provided in the partition panel 13 on its surface facing the front panel 11. The positions of the depressions 18 are directly corresponding to those of the openings 17 formed in the front panel 11.

Figure 6:
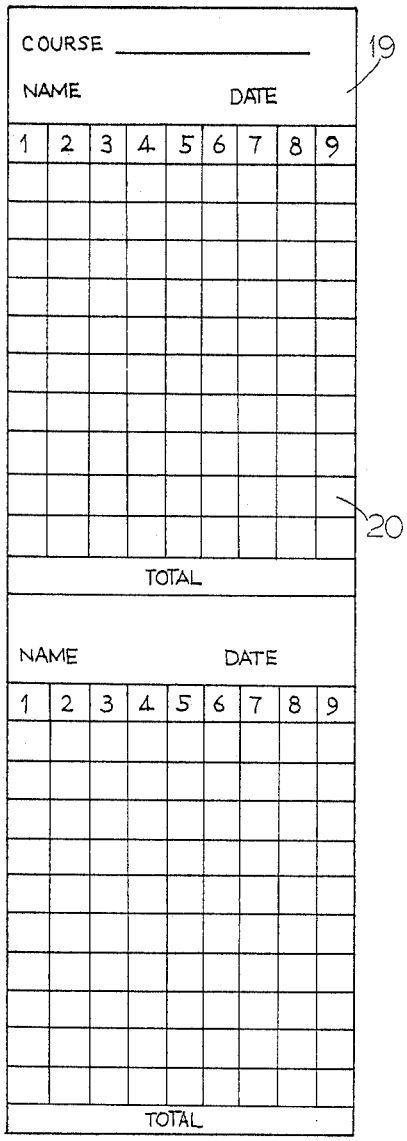
FIG. 6 shows a score card for use with the recording device.

A score card 19 for use with the recorder has a format as shown in FIG. 6. The score card 19 may be made of paper or other perforable sheet material. The format also has two groups of nine rows of square areas 20. The upper group may be used to record the scores in the playing of the front nine holes in the golf game. Each square area in a numbered row in the score card is for recording each stroke played in the course of that particular numbered hole. Similarly, the lower group of squares are for recording the scores in the back nine holes. When the score card 19 is inserted into the front compartment 14 of the case 10, the square areas 20 are positioned directly behind the openings 17 in the front panel 11. Since the front panel 11 is made of transparent plastic material the information on the score card 19 is clearly visible through the front panel 11.

In operation, the golfer merely inserts a golf tee 21 through the selected opening 17 in the appropriate row to pierce a mark 22 in the score card after playing a stroke during the course of playing each hole. For example, if the upper group is selected to record the front nine holes in the game, then after each stroke is played in the number "1" hole the player would pierce a mark in the row identified as "1".

Since for the average golfer the score in playing each hole is unlikely to exceed ten strokes, ten marking squares are provided on the score card and correspondingly ten openings 17 are provided in the front panel 11. It can be appreciated that the number of openings 17 in each row provided in the front panel 11 and the corresponding number of depressions 18 provided in the partition panel 13 as well as the number of marking square areas 20 provided on the score card 19 may be more or less than ten as shown in the above example. For instance, if the recorder is intended for use by golfers with a high level of skill then less than ten openings in each row will suffice.

One of the advantages of the present recorder is that the player can record each stroke played immediately after each stroke has been played as the game progresses, thus there is no chance for loss of count of the number of strokes played as in the common score card in which the player marks down only the total number of strokes played after the ball is sunken into the hole. Furthermore, with the present recorder the player is not required to carry a pen or pencil for marking the scores on the score card. A common golf tee can be used to make the perforated recording marks. Such golf tee is readily available to the golfer in the golf course. Moreover, since the scores are recorded on the score card in the form of perforated markings; once they are marked they cannot be altered.

Figure 7:
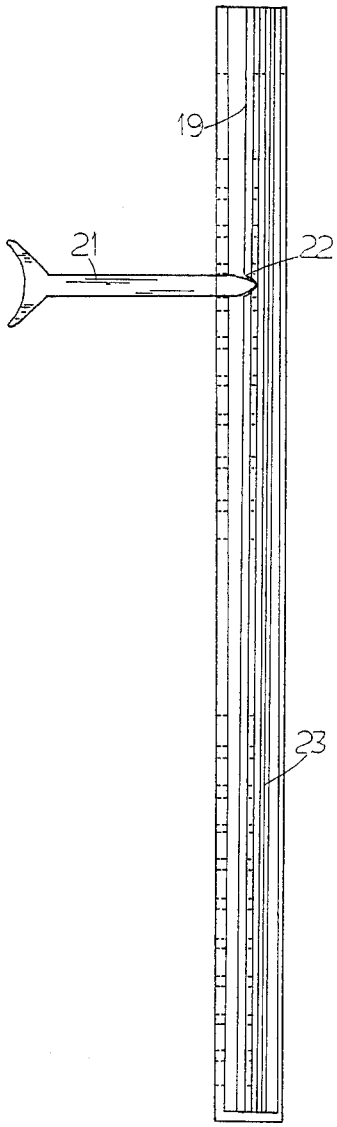
FIG. 7 is a side elevation of the recording device illustrating its operation.

As best shown in FIG. 7 spare score cards 23 may be stored in the rear compartment 15. It can be appreciated that for the sole purpose of scores recording it is not necessary to provide the rear compartment 15.

While the invention has been particularly shown and described with reference to preferred embodiments thereof, it will be understood by those skilled in the art that various changes in form and details mauy be made therein without departing from the spirit and scope of the invention.

I claim:

1. A golf game scores recording device comprising, a portable open top case having a transparent front panel member and a second panel member spaced from and substantially parallel to said front panel member, a cut out portion formed in an edge of said front panel member and said second panel member along said opened top, a plurality of openings formed in said front panel member, said openings being formed in a pattern of two groups of nine rows and having a dimension permitting a golf tee to be inserted therethrough, a plurality of depressions formed in said second panel member on a surface therein facing said front panel member, said depressions having a pattern identical to said openings in said front panel member, and each one of said depressions being positioned directly opposite to one of said openings.

2. A golf game score recording device according to claim 1 including a perforable score card member operative to be inserted in said case, said score card member having a plurality of scores recording areas printed thereon, said areas being aligned with said openings in said front panel member whereby a golf tee is insertable in a selected opening to effect a perforated mark on said score card member for recording the scores.

3. A golf game scores recording device according to claim 2 including, a rear panel member parallel to said second panel member forming a storage compartment therewith for storing a plurality of said score card members.

4. A golf game scores recording device according to claim 3 wherein said openings in said front panel member are circular openings having a diameter of at lesat 3/16 inch permitting a golf tee to be inserted therethrough to mark said score card member in said score card compartment.

5. A golf game scores recording device according to claim 4 wherein said pattern comprises ten openings in each of said nine rows.

* * * * *